US005752155A

United States Patent [19]

Gates, Jr. et al.

[11] Patent Number: 5,752,155

[45] Date of Patent: May 12, 1998

[54] GREEN HONED CUTTING INSERT AND METHOD OF MAKING THE SAME

[75] Inventors: Alfred S. Gates, Jr.; Bernard North; William R. Shaffer, all of Greensburg, Pa.

[73] Assignee: Kennametal Inc., Latrobe, Pa.

[21] Appl. No.: 734,511

[22] Filed: Oct. 21, 1996

[51] Int. Cl.[6] ..... B22F 3/12; B22F 3/24; B22F 7/06; B22F 7/08

[52] U.S. Cl. ..... 419/5; 419/26; 419/47; 419/14; 264/434

[58] Field of Search ..... 419/5, 14, 26, 419/47

[56] References Cited

U.S. PATENT DOCUMENTS

| | | | |
|---|---|---|---|
| 4,562,040 | 12/1985 | Yamada et al. | 419/23 |
| 4,609,527 | 9/1986 | Rinderle et al. | 419/32 |
| 4,610,931 | 9/1986 | Nemeth et al. | 428/547 |
| 4,732,622 | 3/1988 | Jones | 148/11.5 P |
| 4,812,370 | 3/1989 | Okada et al. | 428/552 |
| 4,828,612 | 5/1989 | Yohe | 75/238 |
| 4,942,097 | 7/1990 | Santhanam et al. | 428/552 |
| 5,250,367 | 10/1993 | Santhanam et al. | 428/698 |
| 5,266,388 | 11/1993 | Santhanam et al. | 428/212 |
| 5,308,556 | 5/1994 | Bagley | 265/13 |
| 5,336,465 | 8/1994 | Matsumaga et al. | 419/2 |
| 5,376,329 | 12/1994 | Morgan et al. | 419/39 |
| 5,445,790 | 8/1995 | Hu et al. | 419/44 |
| 5,451,469 | 9/1995 | Gustafson et al. | 428/548 |
| 5,484,468 | 1/1996 | Ostlund et al. | 75/236 |

FOREIGN PATENT DOCUMENTS

| | | |
|---|---|---|
| 757375 | 12/1933 | France . |
| 07185909 | 7/1995 | Japan . |
| 262723 | 6/1927 | United Kingdom . |

OTHER PUBLICATIONS

Nemeth et al., "The Microstructural Features and Cutting Performance of the High Edge Strength Kennametal Grade KC850", Proc. Tenth Plansee Seminar, Reatte/Tyrol, Metalwerk Plansee A.G. 1981, pp. 613–627.

PCT International Search Report Mailed Dec. 15, 1997, in counterpart application No. PCT/US97/14289, filed Aug. 13, 1997.

*Primary Examiner*—Daniel J. Jenkins
*Attorney, Agent, or Firm*—Stanislav Antolin

[57] ABSTRACT

A method of producing a cutting insert which includes the steps of: providing a generally homogeneous powder blend of powder components; forming the powder blend into a green body wherein the green body includes a rake face and a flank face with a cutting edge at the juncture of the rake face and the flank face; honing the cutting edge of the green body; and consolidating the green body with the honed cutting edge so as to form a consolidated body with a honed cutting edge.

37 Claims, 1 Drawing Sheet

GREEN HONED CUTTING INSERT AND METHOD OF MAKING THE SAME

BACKGROUND OF THE INVENTION

Cutting inserts are typically produced via powder metallurgical processes. In a typical powder metallurgical process, the powder components are first blended into a generally homogeneous blend so as to provide such a powder blend. The powder blend is then placed into a mold (or die cavity) where the powder is subjected to a pressure so as to form the powder blend into a so-called green body of a green density, i.e., less than final (or full) density. The green body presents a rake face and a flank face which may intersect to form a cutting edge.

The green body is then subjected to a deflashing process by which the flashing is removed from the green body. The deflashing process prepares the green body for the consolidation process.

The green body is then consolidated such as, for example, by sintering, so as to further densify the green body to a final (or full) density. The green body which has been consolidated to its final density may be termed a consolidated body and/or an as-sintered body.

All or part of the rake and flank faces may be ground and then the cutting edge of the consolidated body is honed (a hone is a cutting edge preparation), i.e., hard honed. Brushes may be used to perform the hard honing step.

In the case of a consolidated body that does not exhibit surface binder enrichment, the hard honed consolidated body is then subjected to a cleaning step which, for example, can comprise the application of a chemical to the surface of the consolidated body. If the hard honed consolidated body is to be used as an uncoated cutting insert, then it is ready for use. If the hard honed consolidated body is to be used in a coated condition, the consolidated body is then coated via any one of a number of techniques including without limitation chemical vapor deposition (CVD), physical vapor deposition (PVD) or a combination of CVD and PVD. The coated cutting insert is then ready for use.

In some cases where the consolidated body is to exhibit surface binder enrichment, the hard honed consolidated body is heat treated so as to produce the surface binder enrichment. The heat treated body is then cleaned, and coated via any one of a number of techniques including without limitation chemical vapor deposition (CVD), physical vapor deposition (PVD) or a combination of CVD and PVD. The coated cutting insert is then ready for use.

The above processes produce satisfactory uncoated and coated cutting inserts (with or without surface binder enrichment). However, the existence of necessary manufacturing steps adds manufacturing costs. For example, the presence of the deflashing step adds costs to the manufacture of the cutting inserts. Thus, it would be desirable to provide a process of making a cutting insert, whether coated or uncoated, in which the deflashing step could be eliminated from the manufacturing process.

Some of these manufacturing steps also have the potential to lessen the integrity of the final product. For example, hard honing of the consolidated body tends to contaminate the consolidated body with the components of the abrasive brushes that perform the hard honing. The contamination of the consolidated body with components such as silicon carbide, alumina, and residue of the polymer brush filament is not uncommon. The presence of these contaminants requires the use of a cleaning step. One typical process used to clean the hard honed consolidated body to remove this contamination is the application of a chemical to the surface of the consolidated body. One typical occurrence with the use of chemical cleaning is the leaching away of the binder alloy at the surface of the consolidated body. Leaching away of the binder alloy at the surface of the consolidated body is an undesirable property since it has the potential to degrade the adhesion of a coating to the consolidated body and/or degrade the strength of the consolidated body.

It would be desirable to provide a process of making a cutting insert, whether coated or uncoated, in which the hard honing step could be eliminated from the process. It would also be desirable to provide a process of making a cutting insert, whether coated or uncoated, in which the cleaning step could be eliminated from the process.

SUMMARY

In one form thereof, the invention is a method of producing a cutting insert comprising the steps of: providing a generally homogeneous powder blend of powder components; forming the powder blend into a green body wherein the green body includes a rake face and a flank face with a cutting edge at the juncture of the rake face and the flank face; honing the cutting edge of the green body; and consolidating the green body with the honed cutting edge so as to form a consolidated body with a honed cutting edge.

BRIEF DESCRIPTION OF THE DRAWINGS

The following is a brief description of the drawings of the present patent application.

DETAILED DESCRIPTION

Figure 1:
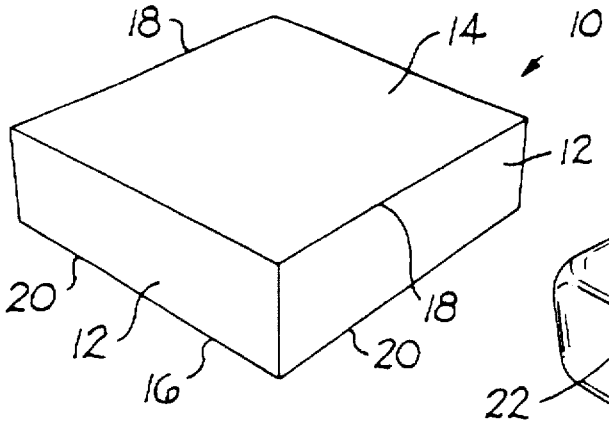
FIG. 1 is an isometric view of a green body for a cutting insert.
Figure 1A:
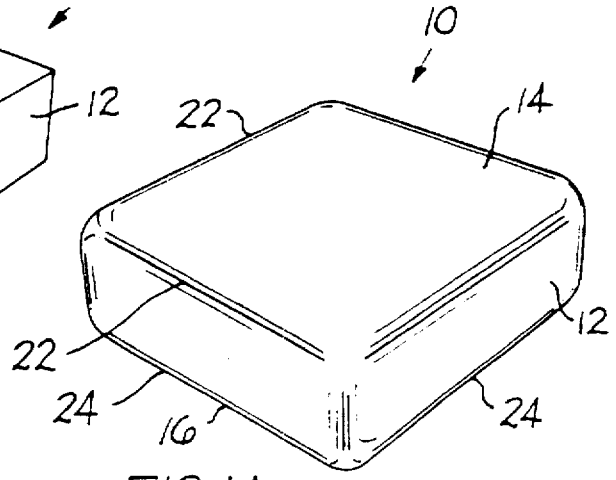
FIG. 1A is an isometric view of the green body of FIG. 1 after having the cutting edges thereof honed (hone exaggerated for illustrative purposes)

Referring to the drawings, FIGS. 1 and 1A illustrate a green body, which comprises a formed (e.g., pressed) mass of powder components (e.g., a metallic binder and at least one hard component) that exhibits a green density, i.e., does not exhibit the final (or full) density of the consolidated body and/or the as-sintered body. FIG. 1 shows the green body 10 in an unhoned condition. FIG. 1A shows the green body 10 in a honed condition, e.g., the cutting edges have been honed using abrasive-impregnated brushes.

Referring to FIG. 1, green body 10 has flank faces 12, a top rake face 14 and a bottom rake face 16. There are top sharp cutting edges 18 and bottom sharp cutting edges 20 at the junctures of the flank faces 12 with the top rake face 14 and the bottom rake face 16, respectively. Referring to FIG. 1A, green body 10 presents flank faces 12 and rake faces (14, 16) like the green body 10 of FIG. 1; however, the difference between these green bodies is that FIG. 1A depicts the green body 10 in the honed condition so there are honed top cutting edges 22 and honed bottom cutting edges 24 (hone exaggerated for illustrative purposes).

The geometry of the green body may vary depending upon the specific application for the cutting insert. In this regard, FIGS. 2 and 2A illustrate a cutting insert which has the same general shape as the cutting insert of FIGS. 1 and 1A, except that it has been rotated about 90 degrees so as to redefine the faces of the cutting insert.

Figure 2:
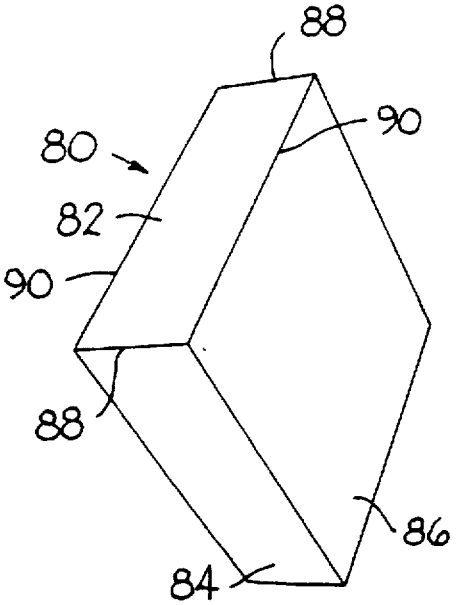
FIG. 2 is an isometric view of another green body for a cutting insert.
Figure 2A:
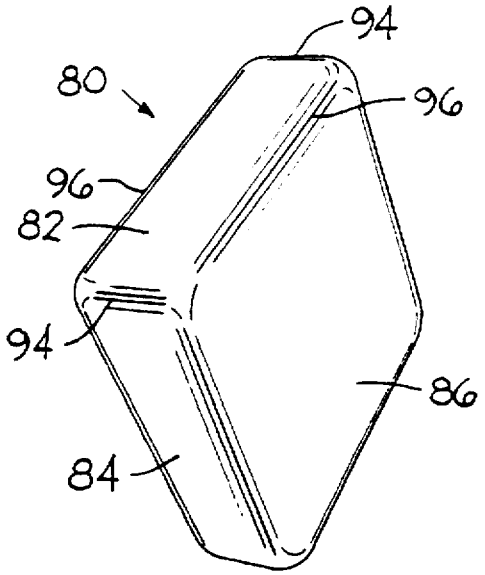
FIG. 2A is an isometric view of the green body of FIG. 2 after having the cutting edges thereof honed (hone exaggerated for illustrative purposes)

More specifically, FIG. 2 presents a green body, generally designated as 80, which has a rake face 82 and flank faces 84 and 86. There are sharp narrow cutting edges 88 at the junctures of the rake face 82 with the narrow flank face 84 and the opposite narrow flank face (not illustrated). There are sharp wide cutting edges 90 at the junctures of the rake face 82 with the wide flank face 86 and the opposite wide flank face (not illustrated). FIG. 2A depicts the green body 80 after it has been honed so as to present honed cutting edges 94 and 96 (hone exaggerated for illustrative purposes).

Figure 3:
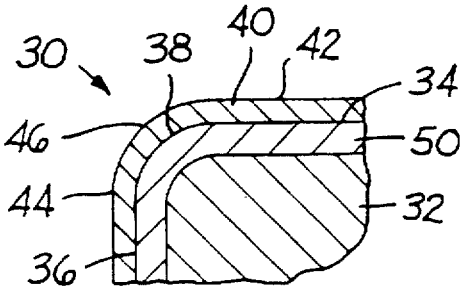
FIG. 3 is a cross-sectional view of a portion of a coated cutting insert utilizing a honed green body whereupon a binder enriched region forms near the surface under the honed edges during and/or following consolidation.

Referring to FIG. 3, there is illustrated a cross-section of a coated cutting insert 30 adjacent the honed cutting edge. Cutting insert 30 has a consolidated body 32 which has a rake face 34, a flank face 36, and a honed top cutting edge 38. The consolidated body 32 is the resultant product of the consolidation of the green body under heat or heat and pressure via a process such as, for example, sintering, liquid phase sintering, vacuum sintering, pressure sintering, and hot isostatic pressing.

The coated cutting insert 30 further includes a coating 40 on the rake face 34 and the flank face 36. The coated cutting insert 30 has a rake face 42, a flank face 44, and a cutting edge 46 at the juncture thereof.

Body 32 presents a region of surface binder enrichment 50 underneath the honed cutting edge 38 of the body 32. The level of surface binder enrichment may range between about 125 percent to about 300 percent of the binder content in the bulk body. One intermediate level of surface binder enrichment ranges between about 150 percent to about 300 percent of the binder content in the bulk body. Another intermediate level of surface binder enrichment ranges between about 200 percent to about 300 percent of the binder content in the bulk body.

In order to achieve the binder enrichment, the body would present a composition which forms binder enrichment near the surface upon consolidation. An exemplary body which has binder enrichment and a bulk substrate with C porosity has a nominal composition of about 6 weight percent cobalt, about 6 weight percent tantalum, about 2 weight percent titanium, and the balance being tungsten and carbon most of which is in the form of tungsten carbide. This body is described in the following article: Nemeth et al., "The Microstructural Features and Cutting Performance of the High Edge Strength Kennametal Grade KC850", Proceedings 10th Plansee Seminar, Reutte, Tyrol, Austria (1981), pp. 613–627, which is incorporated by reference herein.

Another exemplary body with binder enrichment and a bulk substrate with A to B porosity comprises the body described in U.S. Pat. No. 4,610,931 (Reissue Pat. No. 34,180) to Nemeth et al. for PREFERENTIALLY BINDER ENRICHED CEMENTED CARBIDE BODIES AND METHOD OF MANUFACTURE. Still another exemplary body with binder enrichment and a bulk substrate with A to B porosity is described in U.S. Pat. No. 5,250,367 to Santhanam et al. for BINDER ENRICHED CVD AND PVD COATED CUTTING TOOL. U.S. Pat. No. 4,610,931 (Reissue Pat. No. 34,180) to Nemeth et al., and U.S. Pat. No. 5,250,367 to Santhanam et al. are each hereby incorporated by reference herein.

The presence of surface binder enrichment provides certain advantages for a coated cutting insert. These advantages are described in the Nemeth et al. article, U.S. Pat. No. 4,610,931 and U.S. Pat. No. 5,250,367. It can thus be appreciated that to provide a coated cutting insert which exhibits binder enrichment beneath the honed cutting edge is a beneficial feature for the cutting insert of the present invention.

Figure 4:
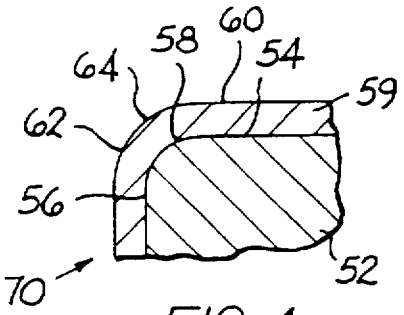
FIG. 4 is a cross-sectional view of a portion of a coated cutting insert utilizing a honed green body that does not present a binder enriched region near the surface of the body.

Although the above description pertains to a body with binder enrichment, the present invention is not limited to bodies with binder enrichment. In this regard, referring to FIG. 4 there is shown a cross-sectional view of a coated cutting insert 70 adjacent the cutting edge thereof. Coated cutting insert 70 has a consolidated body 52 with a rake face 54 and a flank face 56 which intersect to form a honed cutting edge 58. Cutting edge 58 was honed when the body was in the green condition, i.e., a green body. Coated cutting insert 70 includes a coating 59 so that coated cutting insert presents a rake face 60, a flank face 62 and a honed cutting edge 64 at the intersection thereof.

Referring to the process, the steps for the manufacture of the above cutting inserts are described below.

The first step comprises forming a generally homogeneous powder blend of powder components. This step is typically performed by using a ball mill or an attritor mill. The composition of the powder blend may vary but includes cemented carbides (e.g., U.S. Pat. No. 4,610,931), ceramics and cermets (e.g., U.S. Pat. No. 4,942,097 to Santhanam et al. for a CERMET CUTTING TOOL , which is hereby incorporated by reference herein).

The second step comprises forming the powder blend into a green body. The forming process used to form (e.g., pressing, injection molding, casting, etc.) the powder into the green body may vary depending upon the specific process, application, and/or processing parameters. As shown in FIG. 1, the green body 10 includes top and bottom rake faces (14, 16) and a flank face 12 with top and bottom cutting edges (18, 20) at the respective junctures of the rake faces (14, 16) and the flank face 12.

The third step comprises honing the cutting edge of the green body. The honing may be accomplished using a suitable abrasive (e.g., alumina, cubic boron nitride, zirconia, silicon carbide, silicon dioxide) which physically impinges the green body. One exemplary arrangement for the abrasive includes an abrasive-impregnated polymeric fiber (or bristle) brush such as, for example, a silicon carbide impregnated nylon brush, a diamond impregnated nylon brush, and a diamond impregnated nylon brush sandwiched between two silicon carbide impregnated nylon brushes. Even though the above exemplary arrangements identify nylon as the material for the brush, applicants contemplate suitable materials for the brush may include any material that can function as a substrate or matrix to receive and retain an abrasive particle or coating. In this regard, the text by Dr. Raymond B. Seymour entitled "Engineering Polymer Sourcebook", McGraw-Hill Publishing Company, New York (1990), which is hereby incorporated by reference herein, identifies a number of polymeric compositions that are suitable materials.

Referring to specific brushes suitable for use, one line of commercially available brushes is the non-metallic/synthetic brushes sold by Osborn Manufacturing in Cleveland, Ohio (USA). These brushes include a nylon brush, a Korfil A brush (a plastic coated fiberglass filament), a Korfil D brush (a straight plastic monofilament) and Korfil E (round, straight or crimped nylon filaments impregnated with silicon carbide grit). Another commercially available brush is the Nylox® (a federally registered trademark of Patons & Baldwins, Ltd. of Darlington, England) abrasive filament brush (straight, crimped or rectangular nylon filaments) sold by Weiler Brush Company of Cresco, Pa. (USA).

The fourth step comprises consolidating the green body with the honed cutting edge using heat and/or heat and pressure so as to form a consolidated body (e.g., a consolidated body) with a honed cutting edge. The consolidating conditions such as temperature, duration, atmosphere, pressure, heat up parameters, and cool down parameters may vary depending upon such factors as the specific composition of the green body. Typical consolidation processes include, for example, sintering, liquid phase sintering, vacuum sintering, pressure sintering, and hot isostatic pressing.

If the consolidated body is to be used as an uncoated cutting insert, then it is now ready for use.

If the consolidated body is to be used as a coated cutting insert, then the consolidated body is coated with a coating which exhibits suitable properties such as, for example, wear resistance, satisfactory adherence to the consolidated body, chemical inertness with the workpiece material at material removal temperatures, and a coefficient of thermal expansion that is compatible with that of the consolidated body (i.e., compatible thermo-physical properties). The coating may be applied via CVD and/or PVD techniques.

Examples of the coating material, which may comprise one or more layers of one or more different components, may be selected from the following, which is not intended to be all-inclusive: alumina, zirconia, aluminum oxynitride, silicon oxynitride, SiAlON, the borides of the elements from Group IVB, VB and VIB of the Period Table (Chemical Abstracts Service), the carbonitrides of the elements from Group IVB, VB and VIB of the Period Table including titanium carbonitride, the nitrides of the elements from Group IVB, VB and VIB of the Period Table including titanium nitride, the carbides of the elements from Group IVB, VB and VIB of the Period Table including titanium carbide, cubic boron nitride, silicon nitride, carbon nitride, aluminum nitride, diamond, diamond like carbon, and titanium aluminum nitride.

Table I through Table IV present the results of cutting tests for comparative examples (Examples Nos. 1 through 8) and examples of the present invention (Examples Nos. 9 through 20). The bodies and coatings were the same for all of the examples (Examples Nos. 1 through 20). The body was a cobalt-tungsten carbide alloy with a tri-phase coating (TiC-TiCN-TiN) thereon so as to form a coated cutting insert in a CNMG 432 style (See "Identification System for Indexable Inserts for Cutting Tools", American National Standard, ANSI B94.4-1976). The cobalt-tungsten carbide alloy presents a nominal composition of about 8.5 weight percent cobalt, about 10.2 weight percent tantalum, about 5.9 weight percent titanium, up to about 0.4 weight percent niobium in the form of Ta(Nb)C, and the balance tungsten and carbon. The nominal properties comprise an average tungsten carbide grain size of between about 1 micrometers (μm) and about 8 μm, A06, B00, C00 porosity (per the ASTM Designation B 276-86 entitled "Standard Test Method for Apparent Porosity in Cemented Carbides"), a density of about 12,650 kg/m$^3$, a Rockwell A hardness of about 91.2, a magnetic saturation of about 94 percent wherein 100 percent is equal to about 202 microtesla cubic meter per kilogram-cobalt (μTm$^3$/kg) (about 160 gauss cubic centimeter per gram-cobalt (gauss-cm$^3$/gm)), a coercive force of about 140 oersteds, and a transverse rupture strength of about 2170 MPa.

The tri-phase coating is applied according to the teachings of U.S. Pat. No. 4,035,541 to Smith, which is hereby incorporated by reference herein. The nominal thicknesses of the coating layers comprise 4.5 micrometers (μm) for the titanium carbide layer, 3.5 μm for the titanium carbonitride layer, and 3.0 μm for the titanium nitride layer. The overall thickness of the coating is 11.0 μm.

The comparative examples were hard honed, i.e., the bodies were honed in a consolidated condition, with a 240 grit silicon carbide (average particle diameter of 63 micrometers (μm)) impregnated nylon brush. The examples of the invention were green honed, i.e., honed when in the green condition. In regard to the specific honing abrasives, the green bodies were honed with either a 500 grit silicon carbide (average particle diameter of 17 μm) impregnated nylon brush (Table II presents these results), a polycrystalline diamond impregnated Nylon brush (Table III presents these results), or a polycrystalline diamond impregnated nylon brush sandwiched between two silicon carbide (500 grit) impregnated nylon brushes (Table IV presents these results).

The test conditions are set forth below:

operation: turning of AISI (American Iron and Steel Institute) 4340 steel speed 350 surface feet per minute (sfm) [106.7 meters per minute]

feed: 0.012 inches per revolution (0.0305 centimeters per revolution)

depth of cut: 0.080 inches (0.203 cm)

insert style: CNMG-432 lead angle: −5 degrees lubricant: dry

The tool life criteria were: 0.015 inch (0.0381 centimeter [cm]) flank wear for uniform flank wear 0.030 inch (0.0762 cm) flank wear for localized or non-uniform flank wear; and a crater wear depth of greater than 0.004 inches (0:01016 cm). In the present examples, the wear land was governed by the localized wear at the nose of the cutting insert.

TABLE I

Tool Life of Coated Cutting Tools Hard Honed with a SiC (240 grit) Impregnated Brush

| Sample No. | Tool Life (minutes) |
|---|---|
| 1 | 10.4 |
| 2 | 4.6 |
| 3 | 46.7 |
| 4 | 25.9 |
| 5 | 8.4 |
| 6 | 6.8 |
| 7 | 39.1 |
| 8 | 27.3 |

TABLE II

Tool Life of Coated Cutting Tools Honed in the Green Condition with a SiC (500 grit) Impregnated Brush

| Sample No. | Tool Life (Minutes) |
|---|---|
| 9 | 8.4 |
| 10 | 14.6 |
| 11 | 43.6 |
| 12 | 27.5 |

TABLE III

Tool Life of Coated Cutting Tools with the Green Body Honed with a Single Diamond Grit Impregnated Brush

| Example No. | Tool Life (Minutes) |
|---|---|
| 13 | 6.9 |
| 14 | 2.2 |
| 15 | 38.7 |
| 16 | 26.5 |

TABLE IV

Tool Life of Coated Cutting Tools with the Green Body Honed with a Single Diamond Grit Impregnated Brush Sandwiched Between Two SiC (500 grit) Impregnated Brushes

| Sample No. | Tool Life (Minutes) |
|---|---|
| 17 | 10.5 |
| 18 | 30.0 |
| 19 | 35.9 |
| 20 | 25.5 |

Table V sets forth a summary of the average tool life, and properties of the honed cutting edge for the above examples.

TABLE V

The Average Tool Life and Properties of the Honed Cutting Edge for Examples Nos. 1–20

| Example | Average Tool Life (minutes) | Average Hone Size (inches) | Smallest Hone Size (inches) | Largest Hone Size (inches) |
|---|---|---|---|---|
| Hard Honed (Ex. Nos. 1–4) | 21.9 ± 18.8 | .0040 ± .0004 (.0102 ±. 0010 cm) | 0.0035 (0.0089 cm) | 0.0047 (0.0119 cm) |
| Hard Honed (Ex. Nos. 5–8) | 20.4 ± 15.6 | .0039 ± .0002 (.0099 ± .0005 cm) | 0.0036 (0.0091 cm) | 0.0042 (0.0107 cm) |
| Green Honed (Ex. Nos. 9–12) | 23.5 ± 15.6 | 0.0036 ± .0003 (0.0091 ± .0008 cm) | 0.0031 (0.0079 cm) | 0.0038 (0.0096 cm) |
| Green Honed (Ex. Nos. 13–16) | 18.6 ± 17.1 | 0.0039 ± .0005 (0.0099 ± .0013 cm) | 0.0031 (0.0079 cm) | 0.0046 (0.0117 cm) |
| Green Honed (Ex. Nos. 17–20) | 25.5 ± 10.9 | 0.0037 ± .0005 (0.0094 ± .0013 cm) | 0.0030 (0.0076 cm) | 0.0043 (0.0109 cm) |

For these examples, the average hone size for the green honed cutting inserts and the average hone size for the hard honed cutting inserts are essentially the same. The average tool life for the green honed cutting inserts appears to be substantially equivalent to the tool life of the hard honed cutting inserts. Thus, it becomes apparent that the green honing of green bodies produces a cutting insert by a manufacturing process that provides meaningful advantages without sacrificing any of the performance properties of the cutting insert.

More specifically, the green honing of the green body not only eliminates the deflashing step from the earlier process, but also eliminates the hard honing step after the consolidation step. The elimination of the deflashing step and the hard honing step reduces the manufacturing costs associated with the manufacture of the cutting inserts.

The green honing of the green body eliminates the cleaning step which is necessary after the step of hard honing the consolidated body. The elimination of the cleaning step reduces the manufacturing costs. The elimination of the cleaning step also removes a step which has the potential to negatively impact upon the adhesion of the coating to the consolidated body.

For those cutting inserts which present surface binder enrichment, the green honing of the green body eliminates the need to heat treat the hard honed consolidated body. The elimination of the heat treating step reduces the cost of manufacture.

The green honing of the green body causes less wear on the brushes than does the hard honing of the consolidated body. Thus, green honing results in a longer life for the brushes that perform the honing operation as compared to the brushes that hard hone the consolidated body.

While the above examples use a brush to hone the green cutting inserts, the inventors contemplate that other methods can be used to hone the green body. For example, one such method is the use of a fluid stream with hard particles entrained therein (e.g., a stream of carbon dioxide with dry ice particulates entrained therein) wherein the fluid stream impinges the green body so as to hone the cutting edges thereof.

All patents and other documents identified in this application are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A method of producing a cutting insert comprising the steps of:

providing a generally homogeneous powder blend of powder components;

forming the powder blend into a green body wherein the green body includes a rake face and a flank face with a cutting edge at the juncture of the rake face and the flank face;

honing the cutting edge of the green body; and consolidating the green body with the honed cutting edge so as to form a consolidated body with a honed cutting edge.

2. The method of claim 1 further including the step of coating the consolidated body with a coating.

3. The method of claim 2 wherein the coating comprises one or more layers applied by either one or both of chemical vapor deposition or physical vapor deposition.

4. The method of claim 1 wherein the consolidated body includes a region of binder enrichment near the surface adjacent the honed cutting edge.

5. The method of claim 4 further including the step of coating the consolidated body with a coating.

6. The method of claim 5 wherein the coating comprises one or more layers applied by either one or both of chemical vapor deposition or physical vapor deposition.

7. The method of claim 1 wherein the consolidated body is selected from the group consisting of cemented carbides, ceramics and cermets.

8. The method of claim 1 wherein the honing step comprises impinging the cutting edge of the green body with a brush.

9. The method of claim 8 wherein the brush includes at least a portion thereof that is an abrasive impregnated in a bristle.

10. The method of claim 8 wherein the brush includes at least a portion thereof that is a silicon carbide impregnated polymeric bristle.

11. The method of claim 8 wherein the brush includes at least a portion thereof that is a diamond impregnated polymeric bristle.

12. The method of claim 1 wherein the honing step comprises impinging a fluid stream upon the cutting edge of the green body.

13. The method of claim 12 wherein the fluid stream has hard particles entrained therein.

14. The method of claim 1 wherein the consolidating step comprises liquid phase sintering.

15. A method of producing a cutting insert comprising the steps of:

providing a generally homogeneous powder blend comprising a metallic binder and at least one hard component;

forming the powder blend into a green body wherein the green body includes a rake face and a flank face with a cutting edge at the juncture of the rake face and the flank face;

honing the cutting edge of the green body; and consolidating the green body with the honed cutting edge so as to form a consolidated body with a honed cutting edge.

16. The method of claim 15 further including the step of coating the consolidated body.

17. The method of claim 16 wherein the coating comprises one or more layers applied by either one or both of chemical vapor deposition or physical vapor deposition.

18. The method of claim 15 wherein the consolidated body includes a region of binder enrichment near the surface adjacent the honed cutting edge.

19. The method of claim 15 wherein the honing step comprises impinging the cutting edge of the green body with a brush.

20. The method of claim 19 wherein the brush includes at least a portion thereof that is an abrasive impregnated bristle.

21. The method of claim 15 wherein the consolidating step comprises liquid phase sintering.

22. The method of claim 19 wherein the brush includes at least a portion thereof that is a silicon carbide impregnated polymeric bristle.

23. The method of claim 19 wherein the brush includes at least a portion thereof that is a diamond impregnated polymeric bristle.

24. The method of claim 15 wherein the honing step comprises impinging a fluid stream upon the cutting edge of the green body.

25. The method of claim 24 wherein the fluid stream has hard particles entrained therein.

26. The method of claim 15 wherein the consolidated body comprises cemented carbides or cermets.

27. A method of producing a cemented carbide cutting insert comprising the steps of:

providing a generally homogeneous powder blend of powder components;

forming the powder blend into a green body wherein the green body includes a rake face and a flank face with a cutting edge at the juncture of the rake face and the flank face;

honing the cutting edge of the green body; and consolidating the green body with the honed cutting edge so as to form a consolidated cemented carbide body with a honed cutting edge.

28. The method of claim 27 further including the step of coating the consolidated cemented carbide body.

29. The method of claim 27 wherein the coating comprises one or more layers applied by either one or both of chemical vapor deposition or physical vapor deposition.

30. The method of claim 27 wherein the consolidated cemented carbide body includes a region of binder enrichment near the surface adjacent the honed cutting edge.

31. The method of claim 27 wherein the honing step comprises impinging the cutting edge of the green body with a brush.

32. The method of claim 31 wherein the brush includes at least a portion thereof that is an abrasive impregnated bristle.

33. The method of claim 27 wherein the consolidating step comprises liquid phase sintering.

34. The method of claim 31 wherein the brush includes at least a portion thereof that is a silicon carbide impregnated polymeric bristle.

35. The method of claim 31 wherein the brush includes at least a portion thereof that is a diamond impregnated polymeric bristle.

36. The method of claim 27 wherein the honing step comprises impinging a fluid stream upon the cutting edge of the green body.

37. The method of claim 27 wherein the fluid stream has hard particles entrained therein.

* * * * *